United States Patent [19]

Callaway

[11] 4,371,998

[45] Feb. 8, 1983

[54] HYBRID FLOTATION MATTRESS HAVING PROTECTING, WATER PROOF LINER

[75] Inventor: Milton A. Callaway, Medford, Oreg.

[73] Assignee: Simmons U.S.A. Corporation, Atlanta, Ga.

[21] Appl. No.: 221,876

[22] Filed: Dec. 31, 1980

[51] Int. Cl.[3] ..... A47C 27/08

[52] U.S. Cl. ..... 5/451; 5/477

[58] Field of Search ..... 5/451, 452, 450, 455, 5/449, 441, 474, 477

[56] References Cited

U.S. PATENT DOCUMENTS

| | | | |
|---|---|---|---|
| 3,735,432 | 5/1973 | Kreten et al. | 5/451 |
| 4,145,780 | 3/1979 | Fogel | 5/451 |
| 4,187,566 | 2/1980 | Peterson | 5/451 |
| 4,193,151 | 3/1980 | Callrance | 5/455 |
| 4,245,362 | 1/1981 | Mueller | 5/451 |
| 4,245,364 | 1/1981 | Callrance | 5/452 |

*Primary Examiner*—Alexander Grosz

[57] ABSTRACT

A hybrid flotation mattress of the type having a center water bag surrounded by at least one row of resilient bedding material is provided. A protective water resistant liner is further provided between the water bag and the resilient material as is a bridge liner on the top surface of the mattress, extending inwardly from the resilient material over the interface between the resilient material and the water bag.

1 Claim, 2 Drawing Figures

HYBRID FLOTATION MATTRESS HAVING PROTECTING, WATER PROOF LINER

BACKGROUND OF THE INVENTION

The present invention relates generally to a flotation mattress and, more particularly, to a hybrid flotation mattress of the type including a center water bag surrounded by at least one row of conventional bedding helical coil springs or foam. The mattress further includes a protective liner separating the water bag from the row of coil springs or foam and a bridge liner covering the interface between the coil springs or foam and its water bag in order to prevent any water leakage from the mattress to the coil springs or foam.

In any flotation or waterbed product, a particular concern is the potential property damage which may occur should a leak develop in the water bag which could result in damage to the platform of the bed. In hybrid flotation systems such small leaks can further result in damage to the springs or foam. Seepage of water into such sections may result in rusting of the helical coil springs or cause mildew in the foam sections.

Against the foregoing background, it is a primary objective of the present invention to provide a hybrid flotation mattress having a water bag surrounded by conventional resilient bedding material between which is provided a protective liner to prevent seepage of water from the water bag.

It is another objective of the present invention to provide a hybrid flotation product having a water bag surrounded by conventional resilient bedding material separated by a protective liner to prevent seepage of water from the water bag and further including a bridge liner over the interface between the waterbag and surrounding resilient material.

SUMMARY OF THE INVENTION

To the accomplishments of the foregoing objects and advantages, the present invention, in brief summary, comprises a hybrid flotation mattress of the type having a center water bag surrounded by at least one row of resilient bedding material. A protective water resistant liner is further provided between the water bag and the resilient material. A bridge liner is also provided on the top surface of the mattress extending inwardly from the resilient material and over the interface between the resilient material and the water bag.

BRIEF DESCRIPTION OF THE DRAWINGS

The foregoing and still other objects of the present invention will be made apparent from the following detailed explanation of the preferred embodiments of the present invention in connection with the accompanying drawings, wherein.

DESCRIPTION OF THE PREFERRED EMBODIMENTS

Figure 1:
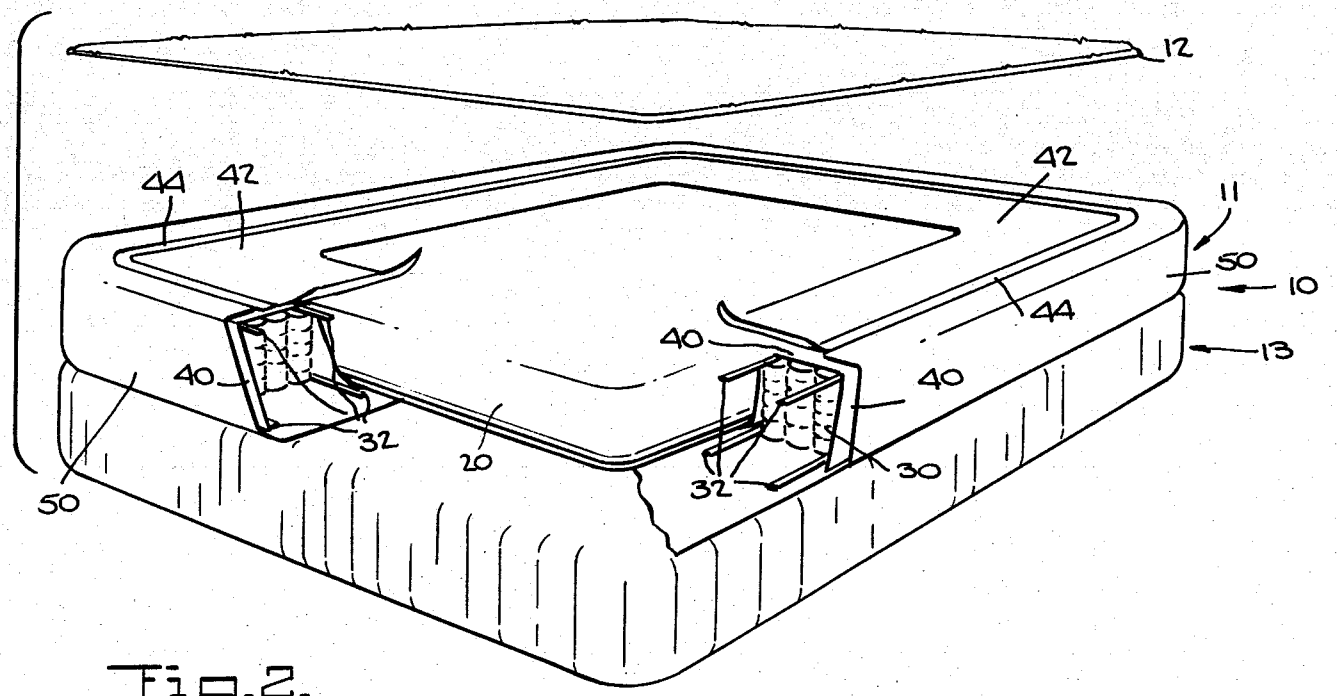
FIG. 1 is a perspective, partial cut-away view of the hybrid flotation system of the present invention.

Referring now to FIG. 1, there is shown the hybrid flotation system of the present invention referred to generally by reference numeral 10, which includes a flotation mattress 11, including pillow top 12, adapted to be mounted atop a platform 13.

Flotation mattress 11 is a hybrid, that is, it includes a central water bag 20 surrounded by resilient bedding material, preferably conventional bedding helical coil springs 30. In the embodiment shown in FIGS. 1 and 2, the helical coil springs 30 are individually encased in an encasing or pocketing material to provide a continuous row or strip of pocketed wire coil springs. As shown in FIG. 1, this continuous row, preferably at least three springs wide, extends around the outer periphery of the flotation mattress 11. It is understood, however, that a greater or lesser number of springs may be utilized; that the springs 30 may be of the open coil variety, that is, they need not be pocketed in an encasing material; and further that other resilient bedding products, such as, for example, foam, may be used around the water bag 20.

Figure 2:
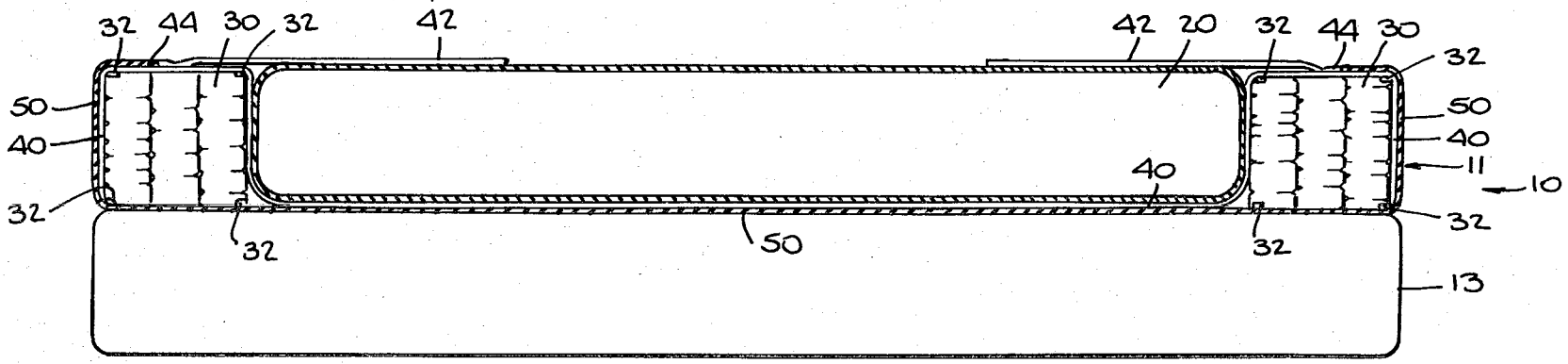
FIG. 2 is a side cutaway view thereof.

In the embodiment shown in FIGS. 1 and 2, the helical coil springs are pocketed in strips of fabric, preferably nonwoven thermoplastic fiber material with each individual spring being separated by seams effected by an ultrasonic welding technique or by a stitching or seaming technique. In this manner the springs are interconnected, however, still retain a degree of independence.

To provide edge firmness, border wires 32 preferably four in number, are provided on the outer edges of springs 30. The border wires 32 provide a degree of edge firmness, particularly should someone sit on the edge of the mattress 11.

A pillow top 12 is provided to cover the upper portion of the mattress 11 and is secured thereto by conventional securing means, such as, for example, hook and loop type fasteners, zippers and the like.

The protective liner of the present invention, referred to generally by reference numeral 40, is adapted to encircle the side and top portions of springs 30 and extend underneath the water bag 20.

In this manner, the protective liner 40 is situated between the water bag 20 and the coil springs 30. A bridge liner 42 is further provided, secured to protective liner 40 atop the springs 30 and extending inwardly about the mattress 11 over the water bag 20. Bridge liner 42 preferably terminates short of the center of water bag 20 to permit access to water bag 20 yet still overlay the interface between water bag 20 and spring section 30. Bridge liner 42 is secured to protective liner 40 by conventional securing means such as, for example, heat sealing at 44. As shown in the Figures, bridge liner 42 is actually an extended portion of liner 50 which envelopes the water bag 20, springs 30, and protective liner 40.

Protective liner 40 and bridge liner 42 each may be fabricated from virtually any water resistant material, preferably vinyl or rubber. The outer portion of the spring section 30 is covered by conventional bedding ticking which extends around and under the flotation mattress 11. When pillow top 12 is secured to flotation mattress 11, the flotation mattress gives the appearance of a conventional mattress.

The combination of the protective liner 40, which totally encircles springs 30 and the underside of the water bag 20, and the bridge liner 42, which extends over the interface between the water bag 20 and spring section 30, effectively contains all water which may leak or seep out of water bag 20 in the event of a break. By extending bridge section 42 internally only partway over water bag 20, as shown in FIGS. 1 and 2, the water bag 20 is easily accessible for inspection and filling and/or refilling.

What is claimed is:

1. A hybrid flotation mattress comprising:

a perimeter of resilient bedding material defining a central cavity;

a water bag positioned within said central cavity;

a first protective liner extending over said perimeter of resilient bedding material, between said perimeter and said water bag, and underlying said water bag;

a second protective liner enveloping said perimeter, said water bag, and said first protective liner, a portion of said second protective liner extending over the peripheral portions of said water bag and defining an opening allowing access to said water bag, said second protective liner being sealed to said first protective liner above said perimeter of resilient bedding material thereby preventing any leakage from said water bag from reaching said perimeter.

* * * * *